US010955189B2

(12) United States Patent
Saribal et al.

(10) Patent No.: US 10,955,189 B2
(45) Date of Patent: Mar. 23, 2021

(54) VIBRATORY FLUIDIZED BED DRYER

(71) Applicant: Oliver Manufacturing Company, Inc., La Junta, CO (US)

(72) Inventors: Okan Saribal, La Junta, CO (US); Matthew Barnes, La Junta, CO (US)

(73) Assignee: Oliver Manufacturing Company, Inc., La Junta, CO (US)

( * ) Notice: Subject to any disclaimer, the term of this patent is extended or adjusted under 35 U.S.C. 154(b) by 0 days.

(21) Appl. No.: 16/223,371

(22) Filed: Dec. 18, 2018

(65) Prior Publication Data

US 2019/0186832 A1 Jun. 20, 2019

Related U.S. Application Data

(60) Provisional application No. 62/599,906, filed on Dec. 18, 2017.

(51) Int. Cl.

| | |
|---|---|
| ***F26B 3/08*** | (2006.01) |
| ***F26B 3/092*** | (2006.01) |
| ***F26B 21/10*** | (2006.01) |
| ***F26B 25/22*** | (2006.01) |
| ***F26B 21/12*** | (2006.01) |

(52) U.S. Cl.

CPC ..... *F26B 3/082* (2013.01); *F26B 3/0923* (2013.01); *F26B 21/10* (2013.01); *F26B 21/12* (2013.01); *F26B 25/22* (2013.01)

(58) Field of Classification Search

CPC ..... F26B 3/082; F26B 3/0923; F26B 21/10; F26B 21/12; F26B 25/22

USPC ..... 34/359

See application file for complete search history.

(56) References Cited

U.S. PATENT DOCUMENTS 4,615,123 A * 10/1986 Brown ..... A23B 7/0053 34/577
4,619,052 A * 10/1986 Osburn ..... E21B 21/063 34/368

(Continued)

FOREIGN PATENT DOCUMENTS

CA 2890735 A1 * 11/2015 ..... F26B 5/00
EP 2828595 B1 * 4/2017 ..... F26B 23/001

OTHER PUBLICATIONS

El-Mesery et al. "Performance of a convective, infrared and combined infrared-convective heated conveyor-belt dryer" J Food Sci Technol (May 2015) 52(5): pp. 2721-2730.

(Continued)

*Primary Examiner* — Stephen M Gravini
(74) *Attorney, Agent, or Firm* — Banner & Witcoff, Ltd.

(57) ABSTRACT

A fluidized bed dryer may include a deck, an eccentric, and a blower. A heater may or may not be included. The deck of the fluidized bed dryer may vibrate due to motion of the eccentric. The blower may blow air through the deck of the fluidized bed dryer to dry material on the deck. As the material dries, the material moves across the deck, due to the vibration. The deck bed depth may be increased, which may allow for even process air flow distribution and control of conveyance speed and residence time. The fluidized bed dryer may include a controller configured to implement a drying process that may include one or more of temperature, moisture content, and relative humidity data to optimize product throughput while ensuring a desired degree of dryness.

12 Claims, 11 Drawing Sheets

(56) References Cited

U.S. PATENT DOCUMENTS 4,950,497 A * 8/1990 Gillette ..... B05C 19/005 118/622
5,161,315 A * 11/1992 Long ..... A23B 9/02 34/580
5,561,916 A * 10/1996 Willgohs ..... F26B 3/084 165/104.16
5,579,588 A * 12/1996 Reh ..... B01J 8/003 34/359
5,809,664 A * 9/1998 Legros ..... F26B 3/088 159/4.01
5,950,325 A * 9/1999 Mehdizadeh ..... F26B 17/04 219/701
6,065,224 A * 5/2000 Eigner ..... C05F 17/964 34/322
7,380,348 B2 * 6/2008 Seebach ..... B04C 3/00 34/326
8,161,663 B2 * 4/2012 Weisselberg ..... C10L 9/083 202/109
8,499,471 B2 * 8/2013 Coronella ..... F02C 3/28 15/26
8,793,900 B2 * 8/2014 Moretto ..... B29B 13/065 34/137
9,234,701 B2 * 1/2016 Wada ..... B02C 13/06
9,347,705 B2 * 5/2016 Crosset ..... F26B 25/003
10,024,598 B2 * 7/2018 Kreuzer ..... B01D 53/78
2004/0134091 A1 * 7/2004 Chickering, III .... A61K 9/1647 34/360
2015/0345863 A1 * 12/2015 O'Gary ..... F26B 5/00 34/509
2019/0186832 A1 * 6/2019 Saribal ..... F26B 3/0923
2019/0211297 A1 * 7/2019 Hui ..... C12N 5/0068

OTHER PUBLICATIONS

"Fluidized Bed Dryer DF" 2015, pp. 1-2.

* cited by examiner

Machine
Shutdown

VIBRATORY FLUIDIZED BED DRYER

CROSS-REFERENCE TO RELATED APPLICATION

This application claims the benefit under 35 U.S.C. § 119(e) of U.S. Application No. 62/599,906, filed Dec. 18, 2017, which is incorporated by reference herein.

BACKGROUND

The drying of treated product may be performed by equipment such as traditional vibratory fluidized bed dryers, infrared heaters, static air dryers, drum dryers (a rotating drum in which the product tumbles and provides residence time for natural convection or forced convection), vibratory conveyors that may allow for residence time for natural convection to occur, or perforated belt-conveyors (in which processed air is passed through the perforated belt and the belt is the method of conveyance).

Drying equipment may be difficult to transport due to their size, having a large footprint, or may require excessive drying time due to inadequate motion between adjacent particles, possibly resulting in clumping of product together and/or and non-uniform distribution of a coated product over a drying surface. Thus, there may be a need for an improved bed dryer.

SUMMARY

The following summary presents a simplified summary of certain features. The summary is not an extensive overview and is not intended to identify key or critical elements.

One or more embodiments may include a fluidized bed dryer comprising: an incoming hopper configured to receive material to be treated and dried; a bed configured to receive the material from the incoming hopper; an eccentric in contact with the bed, the eccentric configured to rotate and cause vibration in the bed, such that the vibration in the bed causes the material to be treated and dried to move across a surface of the bed; and a discharge hopper at an opposite end of the bed relative to the incoming hopper, the discharge hopper configured to discharge the material after the material has been treated and dried.

In one or more embodiments, the fluidized bed dryer may include a blower situated on an opposite side of the eccentric relative to the horizontal bed, the blower configured to blow air across the horizontal bed. In one or more embodiments, the fluidized bed dryer may include a heater configured to heat the air blown by the blower across the horizontal bed.

In one or more embodiments, a process air manifold may be located underneath the horizontal bed. In one or more embodiments, the process air manifold may be a sealing mechanism to the horizontal bed for a pressurized blow-through machine configuration of the fluidized bed dryer.

In one or more embodiments, an exhaust collection hood may be integrated into a structural frame of the fluidized bed dryer.

In one or more embodiments, the horizontal bed may be flat relative to a ground.

One or more embodiments may include a method comprising: activating, by a controller, a blower of a fluidized bed dryer; activating, by the controller, a heater of the fluidized bed dryer; initiating, by the controller, a purge cycle of the fluidized bed dryer; initiating, by the controller, a pilot of the fluidized bed dryer; engaging, by the controller, a burner of the fluidized bed dryer; sending, by the controller, a command configured to spool a feedback loop of the fluidized bed dryer; determining whether a setpoint temperature has been achieved by the heater of the fluidized bed dryer; after determining that the setpoint temperature has been achieved by the heater of the fluidized bed dryer, initiating a continuous operation mode of the fluidized bed dryer; setting, by the controller, one or more control parameters of the fluidized bed dryer to a continuous recipe for the continuous operation mode of the fluidized bed dyer; determining that a cleanout process of the fluidized bed dryer has been activated; loading, by the controller, a cleanout recipe for the cleanout process of the fluidized bed dyer; setting, by the controller, the one or more control parameters of the fluidized bed dyer to the cleanout recipe for the cleanout process of the fluidized bed dyer; determining that a cleanout timeout has been reached; and activating an idle mode of the fluidized bed dryer.

In one or more embodiments, setting the one or more control parameters of the fluidized bed dyer may include: setting an eccentric speed of the fluidized bed dryer; setting a process air mass flow rate of the fluidized bed dryer; setting a mid-deck gate level of the fluidized bed dryer; setting a discharge gate level of the fluidized bed dryer; and setting a burner temperature of the fluidized bed dryer.

In one or more embodiments, a method may include activating a mid-deck gate actuator of the fluidized bed dryer based on the level of the product at the mid-deck gate of the fluidized bed dryer.

In one or more embodiments, a method may include activating a discharge gate actuator of the fluidized bed dryer based on the level of the product at the discharge gate of the fluidized bed dryer.

In one or more embodiments, a method may include receiving temperature information for the fluidized bed dryer from one or more thermocouples associated with the fluidized bed dryer.

In one or more embodiments, a method may include adjusting a heater temperature of the heater of the fluidized bed dryer based on the temperature information from the fluidized bed dryer.

In one or more embodiments, a method may include adjusting a blower speed of the blower of the fluidized bed dryer based on the temperature information from the fluidized bed dryer.

In one or more embodiments, a method may include deactivating, by the controller, an eccentric of the fluidized bed dryer; deactivating, by the controller, the burner of the fluidized bed dryer; determining that the fluidized bed dryer has cooled below a setpoint temperature; and after determining that the fluidized bed dryer has cooled below the setpoint temperature, deactivating, by the controller, the blower of the fluidized bed dryer.

One or more embodiments may include a system comprising: a fluidized bed dryer comprising: an eccentric; a blower; a mid-deck gate; a discharge gate; and/or a heater. The system may include a control device comprising: at least one processor; and memory storing executable instructions that, when executed by the at least one processor, cause the control device to: receive a control recipe comprising one or more control parameters; based on the control recipe comprising the one or more control parameters: set an operational speed of the eccentric, set an operational speed of the blower, and set an operational temperature of the heater; determine that the fluidized bed dryer has been operating based on the one or more control parameters for a threshold period of time; based on determining that the fluidized bed dryer has been operating based on the one or more control parameters for the threshold period of time, activate a shutdown process for the fluidized bed dryer.

In one or more embodiments, a system may include a deck of the fluidized bed dryer, the deck configured such that the deck is flat relative to a ground while the fluidized bed dryer is in operation.

In one or more embodiments, the executable instructions of the memory of the control device, when executed, may cause the control device to: determine a temperature of material being dried by the fluidized bed dryer; and adjust the operational speed of the eccentric based on the temperature of the material being dried by the fluidized bed dryer.

In one or more embodiments, the executable instructions of the memory of the control device, when executed, may cause the control device to: determine a humidity of material being dried by the fluidized bed dryer; and adjust the operational speed of the eccentric based on the humidity of the material being dried by the fluidized bed dryer.

The foregoing and other aspects and features of the present disclosure will become apparent to those of reasonable skill in the art from the following detailed description, as considered in conjunction with the accompanying drawings.

BRIEF DESCRIPTION OF DRAWINGS

The present disclosure is illustrated by way of example and not limited in the accompanying figures in which like reference numerals indicate similar elements and in which.

DETAILED DESCRIPTION

Figure 1:
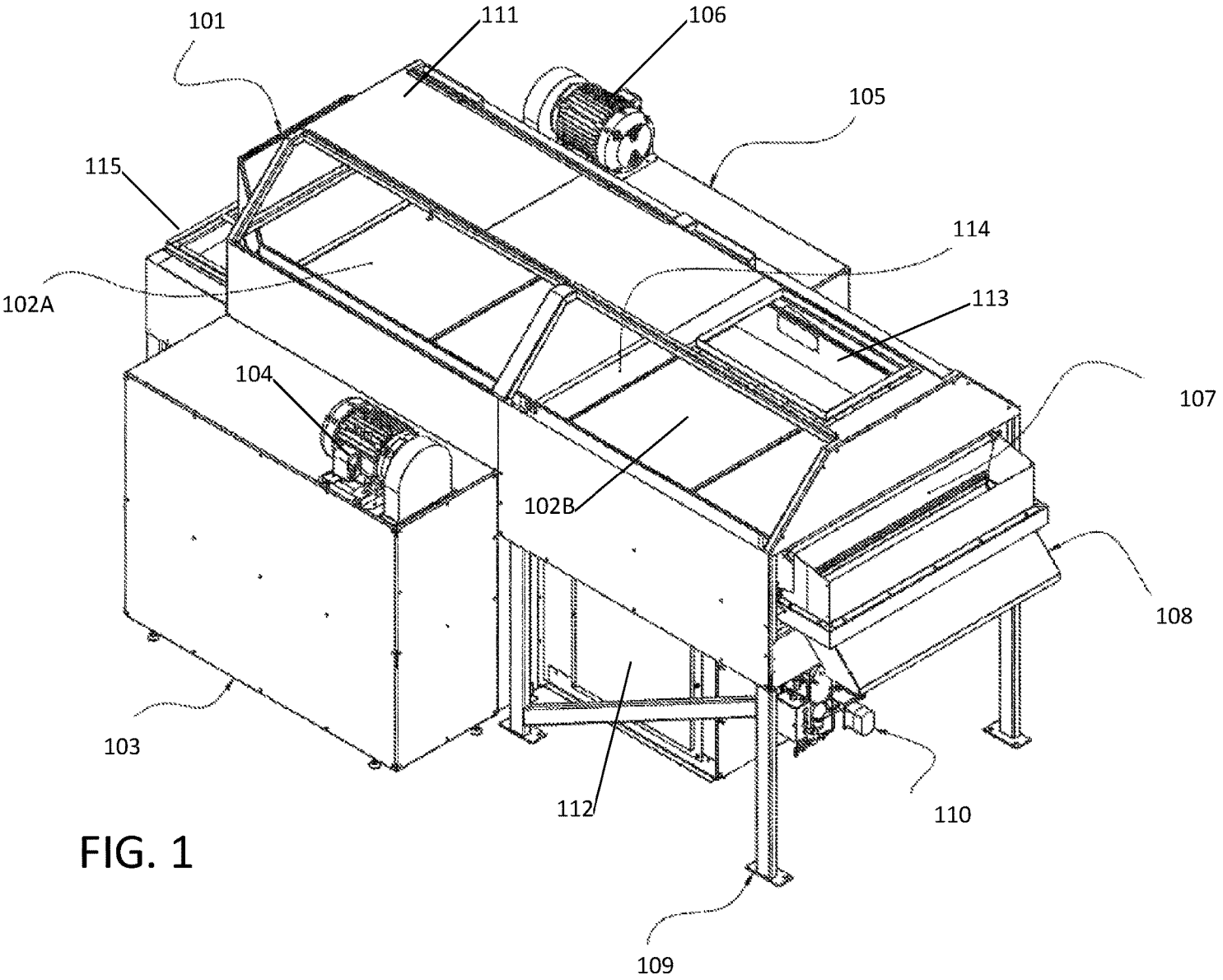
FIG. 1 shows an illustrative isometric view of a vibratory fluidized bed dryer in accordance with one or more embodiments described herein.

In the following description of various illustrative embodiments, reference is made to the accompanying drawings, which form a part hereof, and in which is shown, by way of illustration, various embodiments in which aspects of the disclosure may be practiced. It is to be understood that other embodiments may be utilized, and structural and functional modifications may be made, without departing from the scope of the present disclosure.

A fluidized bed dryer may be designed to reduce industry problems that exist in the drying of chemically treated product. One or more chemical packages may be applied to particulate materials. The particulate materials may include one or more of seed, fertilizer, vegetables, or fruits. The chemical package (e.g., the 'treatment') may be applied to the particulate material via a seed treating system that may dose a metered amount of a treatment directly to the surface of the particulate material through either a batch treater (e.g. a roto-stat) or a continuous-style treater (e.g., drum treater, dosing head with screw conveyor, etc.).

The chemical treatment of some seeds (e.g., soybeans) may be difficult. Due to the application of live biologicals, inoculants, micro-nutrients, binding polymers, colorants, or other active materials, treatment is preferred to be applied close in time to the planting of the seed. This increases the capacity demand of both the treating and drying equipment.

In addition, the temporal properties of applied chemicals present challenges to the drying process. For example, applied chemicals may transfer from the particulate material to any surface handling the product after treatment. One or more embodiments provide a dryer able to be positioned relative to a treater so as to receive particulate material in a wet state from the treater without temporary storage in a vessel or additional transport. In one example, a fluidized bed dryer may be designed to accept treated particulate material having been treated by treating equipment without necessitating additional material handling equipment (e.g., a truck or other container).

In one or more embodiments (e.g., for the soybean treating market), the equipment may support the application, for example, of up to 20 fluid ounces or more of chemical applied per 100 pounds of seed, with a seed capacity of 2,500 pounds or more of seed per minute. In one or more other embodiments, the dryer may be scaled accordingly to provide a smaller physical footprint or greater drying capacity.

Vibratory fluidized bed drying is the process of passing process air (either heated or ambient) upward through a vibrating bed of particulate material to remove moisture from that material. The moving air lifts and fluidizes the particulate material on the bed and allows for the even and efficient mass-transfer of moisture from the surface of the particulate to the process air. In addition, the vibration of the bed may include directional components that convey the particulate material in one or more directions. For instance, an eccentric motion may be provided to the bed to provide vibratory conveyance in the direction of product flow (based at least on a horizontal component) and to assist in fluidization (based at least on a vertical component).

A fluidized bed dryer may be used for the drying of one or both of organic and inorganic treatments applied to particulate material. A fluidized bed dryer may provide higher throughput in a comparatively compact package. This may be accomplished by increasing the depth of product on the bed while adjusting airflow to a given portion of the bed for a given interval. For instance, air flow distribution, control of conveyance speed and residence time per region of a drying deck, and/or drying algorithms may be applied to the dryer to dry the coated product using a smaller physical footprint. For example, one or more inputs may include information from one or more temperature sensors or one or more humidity sensors or one or more moisture sensors to identify the current state of the dryer or the state of the product in the dryer.

In one or more embodiments, the bed dryer may be able to evaporate surface moisture, as well as reduce internal moisture content of the product particulate.

As shown in FIG. 1, in one or more embodiments, a modest machine footprint may be achieved by integrating the numerous components into singular machine sub-systems and/or positioning some components alongside of the dryer as compared to solely underneath. For example, in one or more embodiments, the exhaust collection hood may be integrated into the structural frame of the machine. In one or more embodiments, the process air manifold may be located underneath the deck, and may manage the under-deck flow of process air. In one or more embodiments, the process air manifold may serve as the sealing mechanism to the oscillating deck carriage for pressurized blow-through machine configurations. Further, the blowers and/or at least portions of the plenums may be modular so as to be movable from under the deck to be at least partially horizontally spaced from the deck, thereby allowing the deck to be lowered relative to seed treaters.

FIG. 1 shows an illustrative isometric view of a fluidized bed dryer. A fluidized bed dryer may include one or more sub-systems. For example, a fluidized bed dryer may include a machine mainframe sub-system, a deck carriage and eccentrics sub-system, a deck and rail set sub-system, a retention gate sub-system, and/or a process air sub-system.

The fluidized bed dryer may include a feed hopper 101. Particulate material (e.g., seed, pellets, vegetables, fruits, organic, and/or inorganic materials) having been treated may be introduced to a deck 102A via the feed hopper 101.

A deck and rail set sub-system may include a deck and rail set. The deck and rail set may be affixed to the deck carriage via standard fasteners or other methods of attachment. The rail set is designed to retain the product on the surface of the deck and allow for the varying depths of the product bed (e.g., feed-side bed 102A, discharge-side bed 102B). Material may move across the one or more beds as the material is dried. The deck may be a single fabricated assembly, or an array of deck sections that can be removed and reinstalled in a piece-wise fashion. Further, the deck may include of a variety of different perforation patterns and/or wire overcover specifications (including mesh size, wire size, wire material, and wire coating) depending on the application. For instance, the deck at the feed-side bed 102A may be steel while the deck at the discharge-side bed 102B may be coated steel or other material. One of the benefits of using different deck materials is that the materials may be selected based on the degree of dryness of the product expected to exist when the product is located at that section of the deck. For instance, stainless steel may be used on the feed-side 102A of the deck to permit easier cleaning of treatment transferred from the product to the deck (and possibly sides) when the treatment is still wet or partially dry. A coating (e.g., plastic, polypropylene, PVC, or other material) may coat the surface (or all) of the deck at the discharge-side 102B of the deck to reduce potential scraping of the dried treatment from the coated product. In short, multiple wire materials, coatings and sizes may be utilized on a single machine. The dryer may include a modular gravity feed ramp that may be replaced and/or may be customized to fit the treater discharge without affecting the design of other components.

The fluidized bed dryer may include one or more gates. For example, the fluidized bed dryer may include a discharge gate 107. The fluidized bed dryer may include a discharge hopper 108. The fluidized bed dryer may include middeck gate 114. A retention gate sub-system may include one or more retention gates. The retention gates may be actuated manually or via electronic, pneumatic, or hydraulic actuators to vary the gate position. A dryer may have a retention gate at the discharge end of the deck, with optional mid-deck gates according to the operation desired. The retention gates may be actuated to rotate, displace linearly, or a combination thereof. Retention gates may either fully impede the flow of product or simply slow the progression along the deck.

The fluidized bed dryer may include one or more blower components. For example, the fluidized bed dryer may include a blower bank 103 and/or blower bank 105. The fluidized bed dryer may include a blower motor 104 and/or blower motor 106.

A process air sub-system may include one or more blower arrays. A dryer may be designed to be configured for numerous process air arrangements.

One or more process air arrangements may include a positive pressure blow-through arrangement, in which e.g., one, two, three, four, or more pre-packaged blower arrays may be affixed to the machine mainframe and configured to meet one or more defined physical spatial constraints and/or performance requirements. In one or more embodiments, the blower arrays may be located on either side of the machine, and/or at the feed-end or discharge-end. In one or more embodiments, the blower arrays may be located underneath or some distance away from the machine.

One or more process air arrangements may include a scavenging draw-through arrangement, in which process air may be scavenged through the deck and product bed by attaching process air ducting and equipment to the exhaust collection hood of the machine.

One or more process air arrangements may include a zoned control arrangement, in which zoned control of process air is implemented to allow for rapid heating and cooling of the substrate.

The process air may be heated through a heater (e.g., heater 110) or heating method, which may further increase the rate of moisture removal from the particulate bed. The methods of heating may include, for example, direct fire combustion, indirect-fire combustion and heat-exchanger, resistive coil heat exchanger, hot water or steam heat exchanger, and/or heated oil heat exchanger.

The fluidized bed dryer may include a stand 109. The fluidized bed dryer may include a cover (e.g., cover 111, cover 113), which may be for one or more selectable openings. The fluidized bed dryer may include a plenum 112.

A machine mainframe sub-system may include a structural frame incorporating a plurality of toggle springs to provide flexibility for the eccentric motion of the deck, integrated exhaust collection hood, process air distribution manifold (air chest), and a counter-balanced eccentric drive system. Toggle springs may vary in number, location, and/or orientation to constrain the carriage along the desired path of travel.

A deck carriage and eccentrics sub-system may include a deck carriage and/or an eccentric shaft (e.g., eccentric 115). The deck carriage may be affixed to the mainframe via toggle springs and a number of push rods connected to the eccentric shaft. In one or more embodiments, the deck might not pivot, but may be in a fixed plane, which may be horizontal, vertical, or at an angle. For example, the deck may be flat relative to the ground. In one example, the deck may have a fixed deck tilt such that the tilt of the deck is not alterable during the drying process. In this example, the tilt of the deck is not used to assist the cleanout of the dryer at the end of a batch or at the end of a cycle. Rather, the vibration and fluidization of the deck may provide adequate cleanout.

In another example, the deck may be a tiltable deck, which may be configured to tilt via one or more actuators that permit the deck to be tilted during the operation process.

On a gravity separator, the tilt rack may run perpendicular to the conveyance of the machine. When the machine is being operated, the heavy product may be sent to the elevated side of the tilt deck. On a fluidized bed dyer, which may have a tilt deck, the material may be heavy or wet, and the product may be all the same. The tilting of the dryer may help maintain the product at a given portion of the deck or may be used to equalize the product across the deck. When drying in a fluidized bed dryer, the discharge in the machine may be higher than the feet end, which may be a result of conveying uphill. The tilt deck may be tilted uphill to keep the product on the deck (e.g., otherwise, the product may convey uphill and off the dryer). As mentioned previously, the deck might be relative to the ground (e.g., the deck may be level), and the material conveying across the surface of the deck may be controlled with gates and/or eccentrics speed.

As the eccentric shaft rotates, an oscillating displacement may be induced into the deck carriage for the purposes of vibratory conveyance of the product bed. In one or more embodiments, deck motion may be produced via a linear motor, an unbalanced vibratory motor, and/or other means. The deck carriage may be sealed to the air chest to contain the process air.

Figure 2:
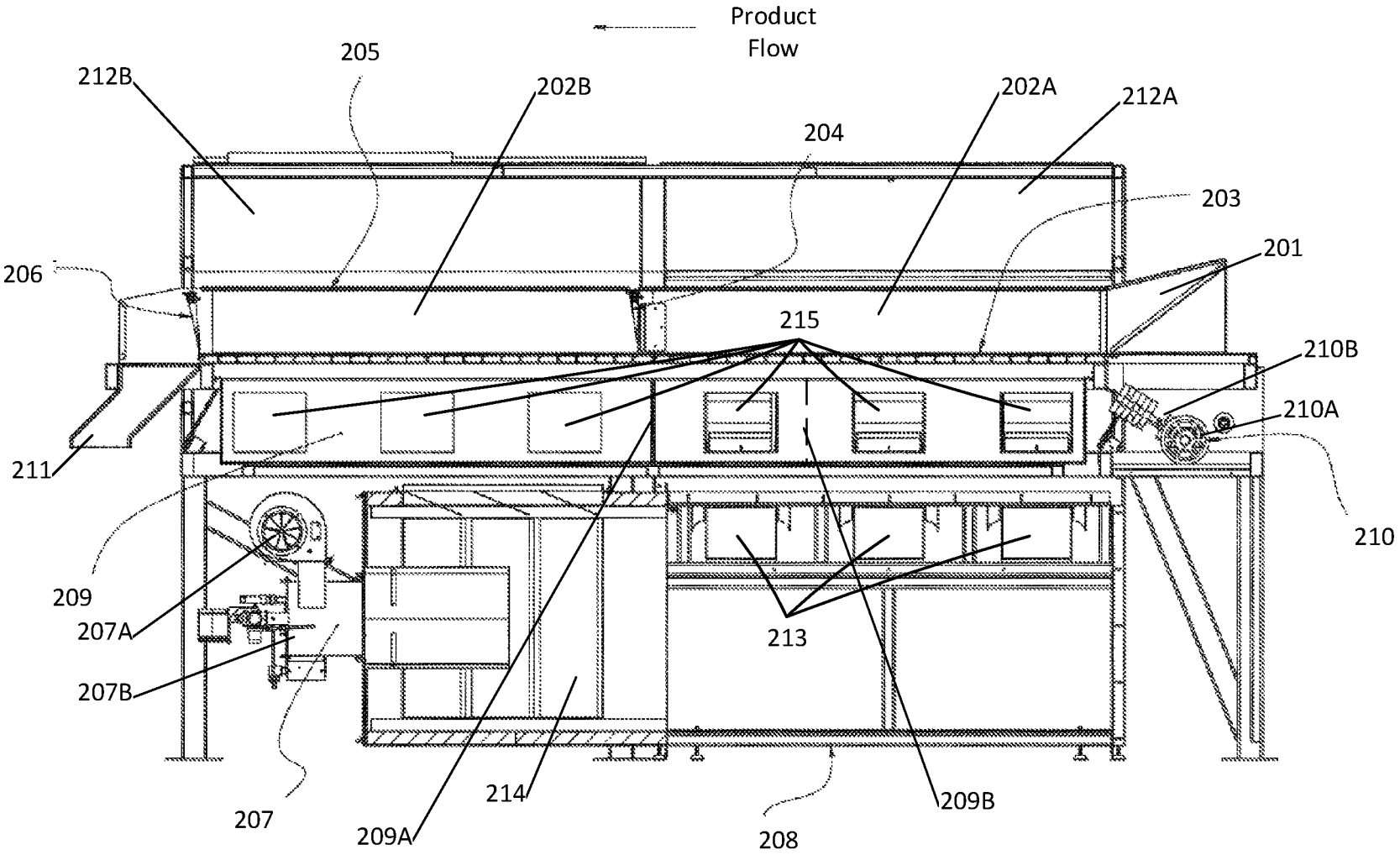
FIG. 2 shows an illustrative profile view of a vibratory fluidized bed dryer in accordance with one or more embodiments described herein.

FIG. 2 shows a profile view of an illustrative fluidized bed dryer, which may be similar to or different from the fluidized bed dryer shown in FIG. 1.

A fluidized bed dryer may include a feed hopper 201. The fluidized bed dryer may include one or more beds (e.g., feed-side bed 202A, discharge-side bed 202B). The fluidized bed dryer may include modular deck 203. The fluidized bed dryer may include railset 205.

The fluidized bed dryer may include eccentric assembly 210. An eccentric assembly (e.g., eccentric assembly 210) may include, for example, a belt driven system with a pulley on the motor and/or a pulley on the shaft. The fluidized bed dryer may include rotating wheel 210A. The fluidized bed dryer may include pulleys and belt 210B.

A fluidized bed dryer may include heater assembly 207. Heater assembly 207 may include, for example, heater blower 207A and/or heater body 207B. The heater may be a gas-fired heater, which might not have a heating element. The heater may include, for example, a heater body, a heater housing, and/or a control assembly.

The fluidized bed dryer may include combustion chamber 214. The fluidized bed dryer may include plenum 208. The fluidized bed dryer may include one or more exhaust plenums (e.g., feed-side exhaust plenum 212A, discharge-side exhaust plenum 212B).

The fluidized bed dryer may include airchest 209. The airchest 209 may have no internal baffles. Additionally or alternatively, the fluidized bed dryer may include one or more optional baffles (e.g., adjustable baffles 209A, 209B). As shown in FIG. 2, the adjustable baffles 209A may be one side of the blower volute. Each of adjustable baffles 209A may point to a curved, closed surface. Airflow may leave the plenum 208 and enter the airchest in one location, e.g., inlets 215. Airflow may enter each adjustable inlet 215 through the side of the volute, e.g., as per a typical centrifugal fan. These inlets are shown in FIG. 2 on each side of each of adjustable baffles 209A.

The fluidized bed dryer may include one or more gates. For example, the fluidized bed dryer may include middeck gate 204. The fluidized bed dryer may include discharge gate 206. The fluidized bed dryer may include discharge hopper 211.

Figure 3:
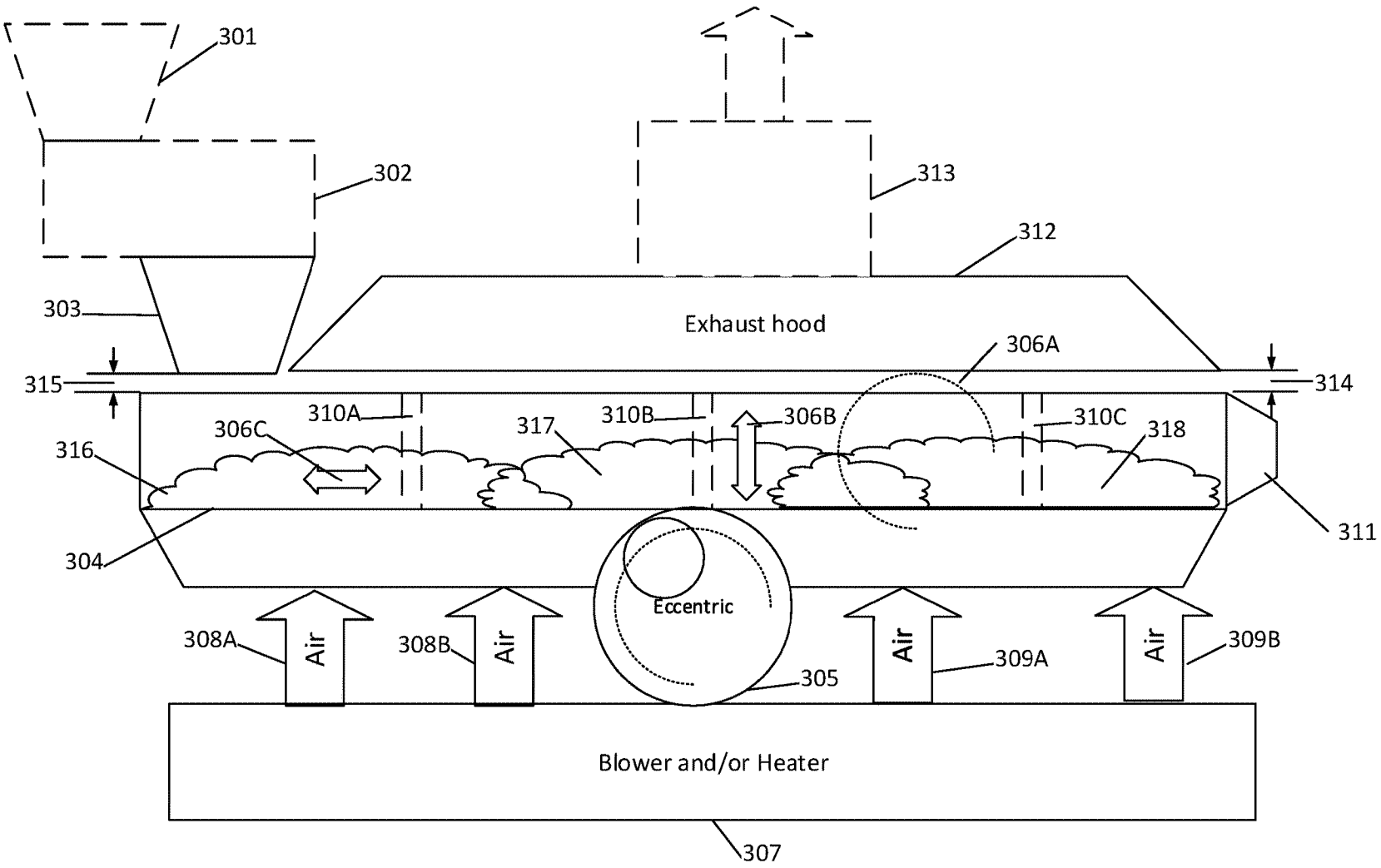
FIG. 3 shows an illustrative block diagram of the parts of a vibratory fluidized bed dryer in accordance with one or more embodiments described herein.

FIG. 3 shows an illustrative diagram of a fluidized bed dryer with various components, and the relationship between these components, as well as how particulate material moves through the fluidized bed dryer.

The fluidized bed dryer may include one or more feed hoppers (e.g., feed hopper 301, feed hopper 303). Particulate material may be added to the fluidized bed dyer via the one or more feed hoppers. The material may have already been treated or the material may be treated by an element attached to the fluidized bed dryer, such as treater 302. After passing through the treater 302, the material may pass to a deck, such as modular deck 304.

The fluidized bed dryer may include eccentric 305. The fluidized bed dryer may include eccentric motion 306A. The fluidized bed dryer may include eccentric vertical component 306B. The fluidized bed dryer may include eccentric horizontal component 306C. Eccentric 305 may rotate, and by rotating cause vibration in the fluidized bed dryer (e.g., in modular deck 304).

The fluidized bed dryer may include blower and/or heater 307. Blower and/or heater 307 may cause air (e.g., heated air) to pass through the deck of the fluidized bed dryer—such as, for example, air 308A, 308B, 309A, 309B.

The fluidized bed dryer may include exhaust hood 312. The fluidized bed dryer may include exhaust motor 313. Exhaust motor 313 may drive exhaust (such as air that has passed through the deck) through exhaust hood 312.

The fluidized bed dryer may include one or more spacing elements (e.g., spacing 314, spacing 315). The spacing elements may create a space between an area above the deck and feed hopper 303 and/or exhaust hood 312.

The fluidized bed dryer may include one or more gates (e.g., gate 310A, gate 310B, gate 310C, gate 311). A gate may be at an end of the deck (e.g., gate 311), or a gate may be midway across a deck (e.g., gate 310A, gate 310B, gate 310C). A gate may open when the particulate material is passing across the deck. If the material needs to be treated for a longer period of time, the gate may be partially or fully closed to prevent the material from moving across the deck (e.g., due to vibration of the deck by motion of the eccentric).

FIG. 3 shows material being treated at various stages across the deck. For example, FIG. 3 shows material at feed-side position 316, material at midstream position 317, and material at discharge-side position 318. As material is treated, vibration of the fluidized bed dryer may cause material to move across the deck from one position to another (e.g., from feed-side position 316 to midstream position 317 to discharge-side position 318).

After the material is treated and dried, the material may exit the fluidized bed dryer via a gate (e.g., gate 311).

Figure 5:
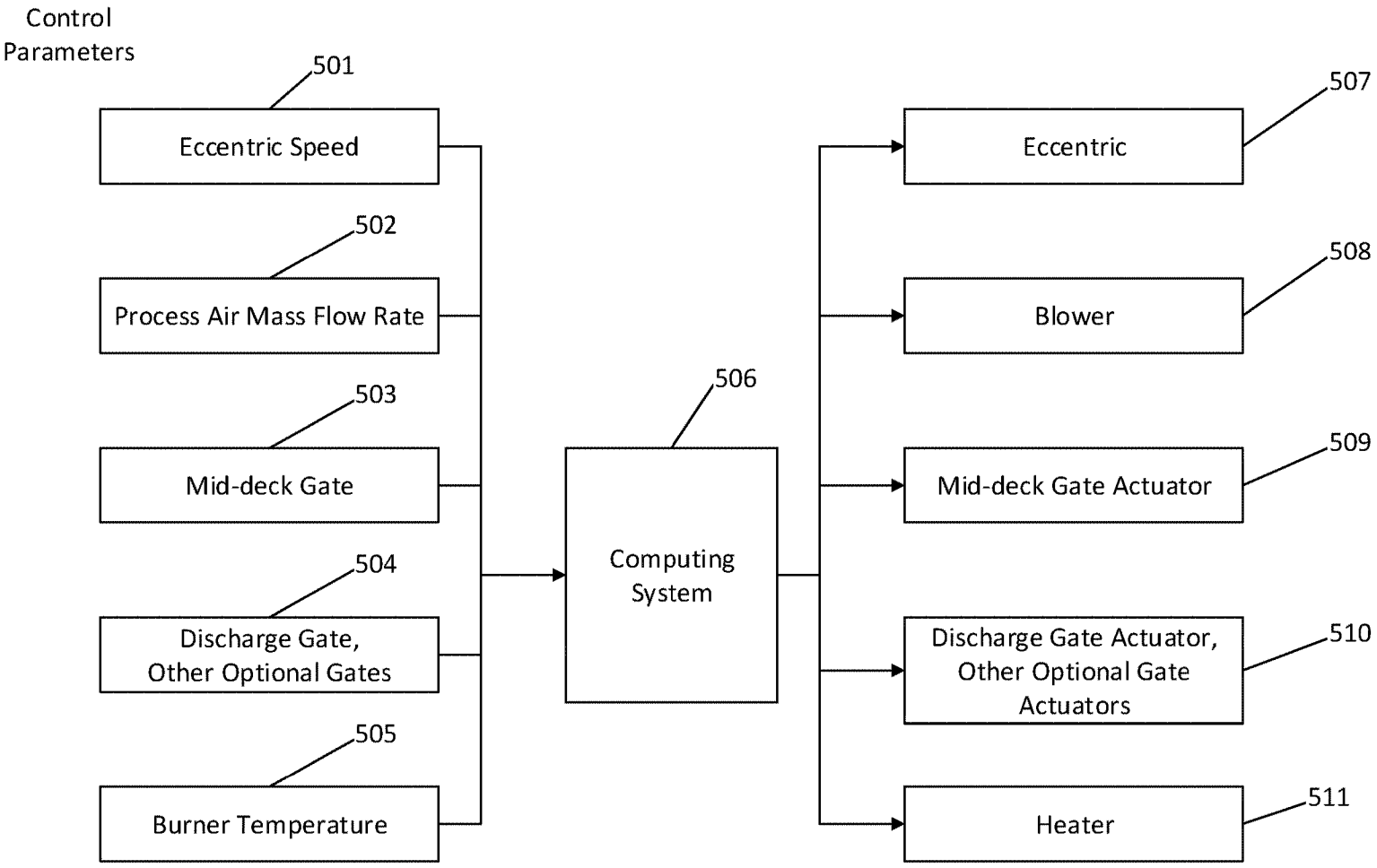
FIG. 5 shows an illustrative block diagram of control system of a vibratory fluidized bed dryer in accordance with one or more embodiments described herein.

FIG. 5 shows an illustrative block diagram of a control system 506 for a fluidized bed dryer.

The control system 506 may include one or more processors. The control system 506 may include memory, which may store executable instructions that, when executed by the one or more processors, cause the control system 506 to perform one or more actions described herein. The executable instructions may, in some embodiments, be stored on one or more non-transitory computer-readable media that, when executed by one or more processors, cause a system, apparatus, or computing device to perform one or more actions described herein. The control system 506 may include a communication interface, which may allow the control system 506 to receive one or more inputs, generate one or more outputs, and/or to interface with one or more other systems, devices, or the like, such as one or more parts of a fluidized bed dryer. The control system 506 may adjust operation of a fluidized bed dryer based on manipulating one or more control parameters, such as control parameters 501-505.

A control parameter may include an eccentric speed 501. The eccentric speed adjustment may affect product throughput rate and/or fluidization characteristics.

A control parameter may include a position of one or more retention gates (e.g., mid-deck gate 503, discharge gate/other optional gates 504). The position of the one or more retention gates may affect retardation of product flow rate and/or bed depth at various locations along the deck length.

Control of product conveyance and drying parameters may be accomplished by varying the eccentric shaft speed 507, the blower 508, retention gates settings (e.g., the mid-deck gate actuator 509, the discharge gate actuator and/or other gate actuators 510), and/or the heater 511. The eccentric speed may determine the velocity of product conveyance, while the retention gate(s) may determine the product bed depth. By articulating the various retention gates, the controller may be able to adjust the machine performance to balance product throughput and total moisture removal from the product bed. These inputs may be either manually adjusted or computer-controlled (e.g., by control system 506).

A control parameter may include a process air mass flow rate 502. Adjusting the process air mass flow rate may allow the machine to fluidize various quantities and densities of product. Process air may be provided from outside of the drying operation area. Flow may be generated through the bed by, e.g., pressurizing the underside of the deck or scavenging air over the top of the deck. Upon leaving the product bed, process air may be discharged from above the product bed.

A control parameter may include a burner temperature 505. Increasing the process air temperature above ambient may provide for greater drying capacity. By elevating the process air temperature above ambient conditions, drying capacity may be increased through reducing relative humidity of the incoming process air stream.

Figure 6:
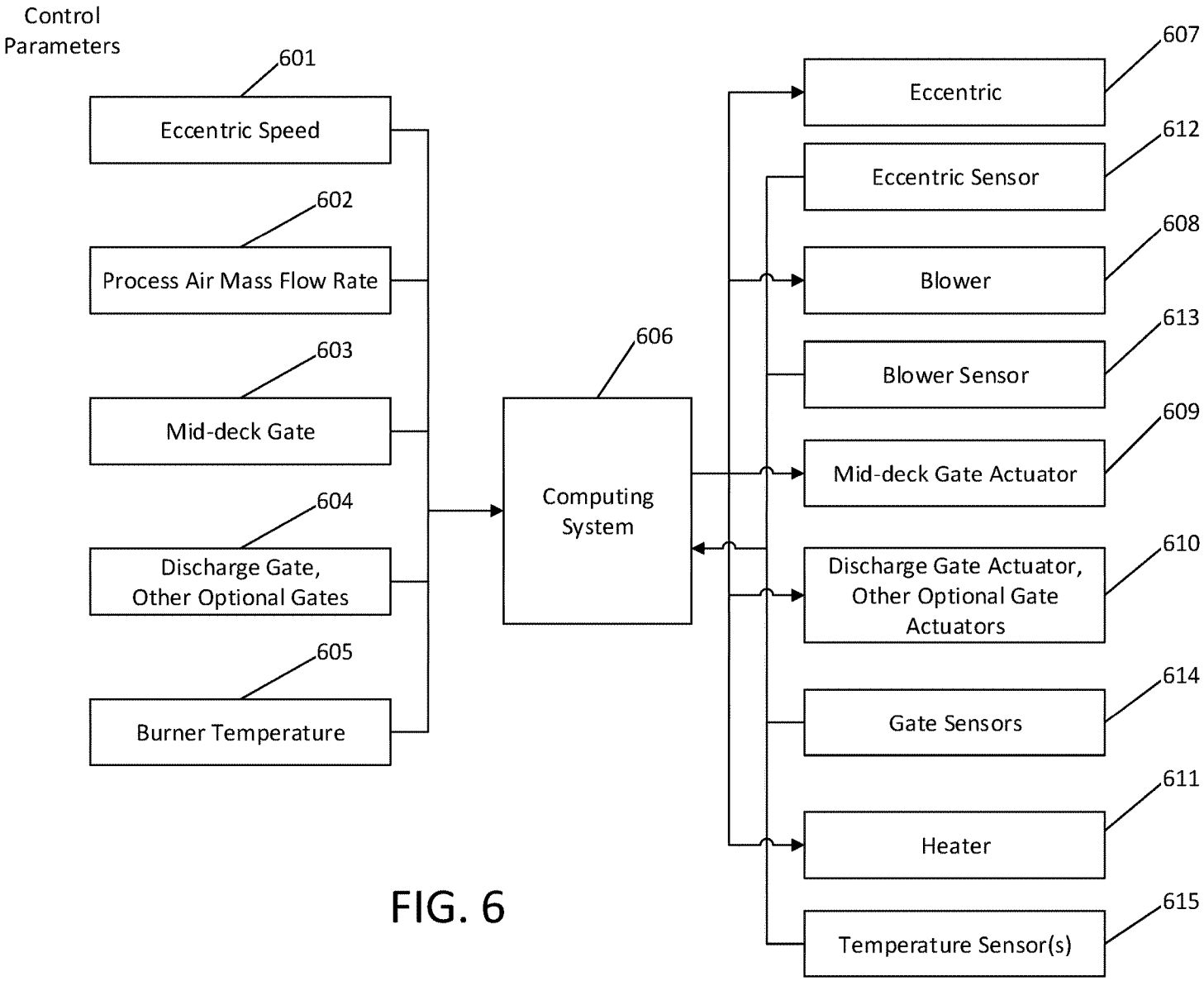
FIG. 6 shows an illustrative block diagram of a control system of a vibratory fluidized bed dryer in accordance with one or more embodiments described herein.

As shown in FIG. 6, a fluidized bed dryer may include one or more sensors, which may be used in conjunction with one or more control parameters for controlling a drying process. The one or more control parameters may be similar to the one or more control parameters described in conjunction with FIG. 5, such as control parameters 501-505 (e.g., eccentric speed 601, process air mass flow rate 602, the positions of the mid-deck gate 603 and/or other gates 604, and the burner temperature 605). For instance, if an air flow rate 602 was set at a given value, but an airflow sensor 613 was reading less air flowing, then a control system 606 may instruct a blower 608 to increase the blower's output until the airflow sensor 613 matched the input mass air flow rate parameter 602.

Control system 606 may be in communication with one or more sensors, which may be configured to measure one or more parameters corresponding to one or more components of a fluidized bed dryer. For example, a fluidized bed dryer may include an eccentric sensor (e.g., eccentric sensor 612), which may be attached to eccentric 607 or to the fluidized bed dryer in a vicinity of eccentric 607, and may be configured to measure one or more parameters of eccentric 607 (e.g., speed of motion, number of rotations).

A fluidized bed dryer may include a blower sensor (e.g., blower sensor 613), which may be configured to measure one or more parameters corresponding to a blower (e.g., blower 608). For example, blower sensor 613 may be configured to measure an airflow velocity of air entering blower 608, an airflow velocity of air exiting blower 608, a decibel volume of blower 608, or one or more other measurements.

A fluidized bed dryer may include one or more gate sensors (e.g., gate sensors 614), which may be configured to measure one or more parameters corresponding to one or more gates of the fluidized bed dryer. For example, gate sensors 614 may be configured to detect an open/close state of a gate. A gate might be partially open or partially closed, and a gate sensor may detect a percentage open or closed of the gate.

Control system 606 may send one or more commands to open or close (partially or fully) a gate. Control system 606 may send the one or more commands to open or close a gate to a gate actuator (e.g., mid-deck gate actuator 609, discharge gate actuator 610). The gate actuator may open or close (partially or fully) a corresponding gate. For example, if a mid-deck gate is closed, and material is passing through the deck and is stopped at the gate, once the material has been stopped at the gate for a threshold period of time, control system 606 may send a command configured to cause mid-deck gate actuator 609 to open mid-deck gate (e.g., to 30% open, to 50% open, to 60% open, to 100% open) and allow the material being dried to pass through. The command may cause mid-deck gate actuator 609 to close the gate after a threshold period of time during which the gate is open.

A tuning loop may be integrated into the dryer such that the average moisture content of discharged product may be varied. A tuning loop may involve using an array of thermocouples placed both in the process air before reaching the product bed, as well as an array of thermocouples placed above or after the air passes through the product bed. The thermocouples may, in one or more embodiments, be the sensors shown in FIG. 6 (e.g., temperature sensors 615). Temperature sensors may be associated with a heater (e.g., heater 611) of the fluidized bed dryer. By monitoring the change in temperature of the process air discharging from the system, an algorithm (e.g., executed by control system 606) may be able to interpolate the average moisture content of the product bed along the length of the dryer and adjust the machine control parameters accordingly.

FIGS. 4A-4D show an illustrative flow chart of one or more processes that may be used for operating a fluidized bed dryer. A fluidized bed dryer may be operated in one or more operational modes. For example, by incorporating the mechanical functionality and computer-controlled features, the fluidized bed dryer may be operated in, for example, a continuous mode, and/or a batch mode.

Continuous mode may be configured to operate the machine in a state of equilibrium with respect to the control parameters.

Batch processing mode may involve a series of timers, which may be pre-programmed into the computer-control system to change machine control parameters at different stages of the drying process. Alternatively or additionally, batch processing may be accomplished via a set of triggers (sensors, scales, ancillary equipment, remote I/O, etc.) to control operation of the machine.

Figure 4A:
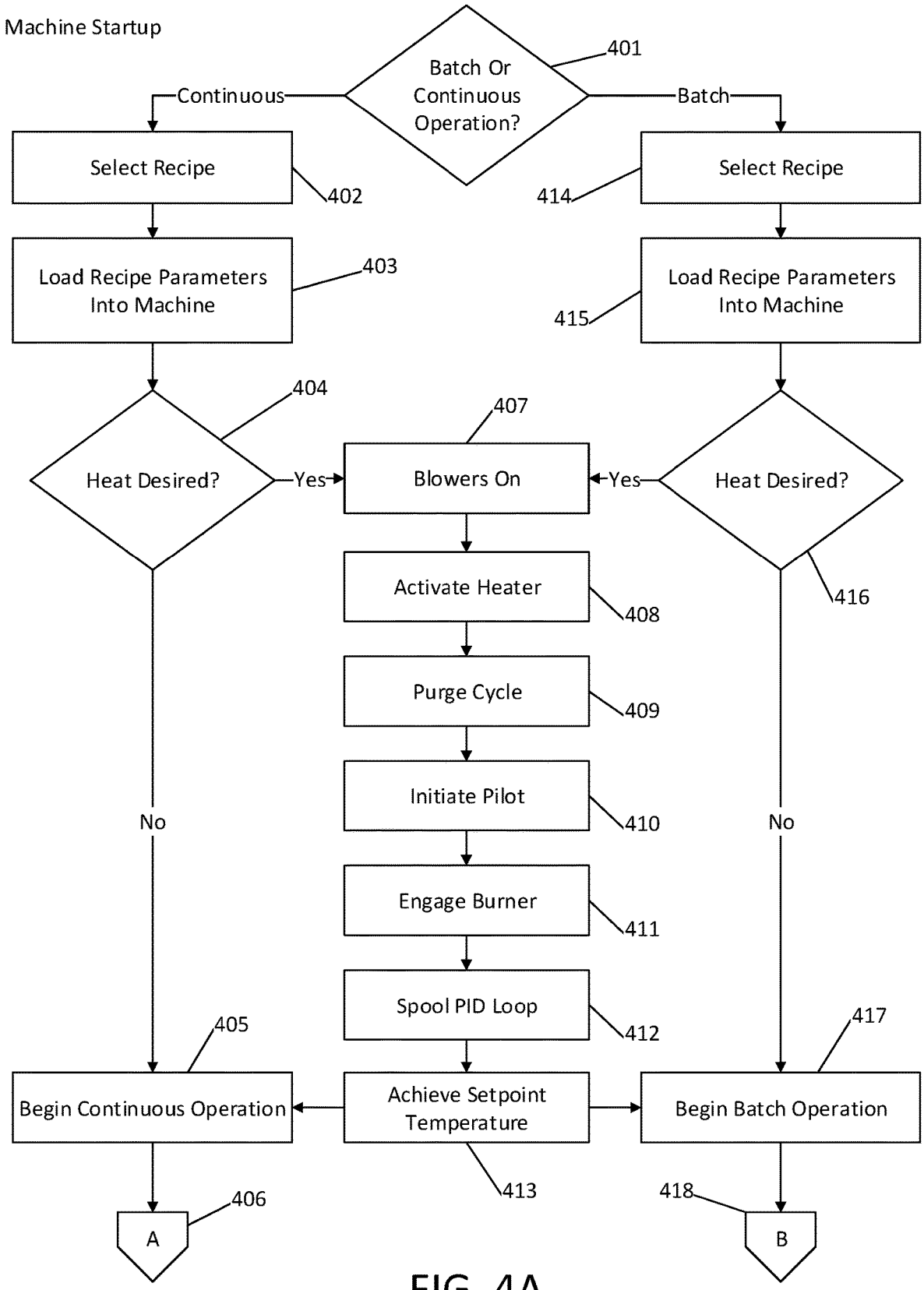
FIGS. 4A-4D show an illustrative flow chart of the operation of a vibratory fluidized bed dryer in accordance with one or more embodiments described herein.

As shown in FIG. 4A, after a machine startup, a process for operating a fluidized bed dryer may be initiated. In step 401, a batch or continuous operation mode may be selected.

If a continuous operation mode is selected, a recipe may be selected 402. The recipe parameters may be loaded 403 into the machine. If heat is not desired 404 in the continuous operation, the continuous operation may begin 405. If heat is desired 404 in the continuous operation, one or more blowers may be activated 407. One or more heaters may be activated 408. A purge cycle 409 may be performed. A pilot may be initiated 410. One or more burners may be engaged 411. A feedback loop may be spooled 412. Once a setpoint temperature has been achieved 413, the continuous operation may begin 405. Various feedback control mechanisms may be used including, but not limited to, a proportional-integral-derivative controller (PID), fuzzy logic, and other mechanisms.

Returning to step 401, if a batch operation mode is selected in step 401, a recipe may be selected 414. The recipe parameters may be loaded 415 into the machine. If heat is not desired 416 in the batch operation, the batch operation may begin 417. If heat is desired 416 in the batch operation, one or more blowers may be activated 407. One or more heaters may be activated 408. A purge cycle 409 may be performed. A pilot may be initiated 410. One or more burners may be engaged 411. A feedback loop may be spooled 412. Once a setpoint temperature has been achieved 413, the batch operation may begin 417 and continue as 418 in FIG. 4C.

Figure 4B:
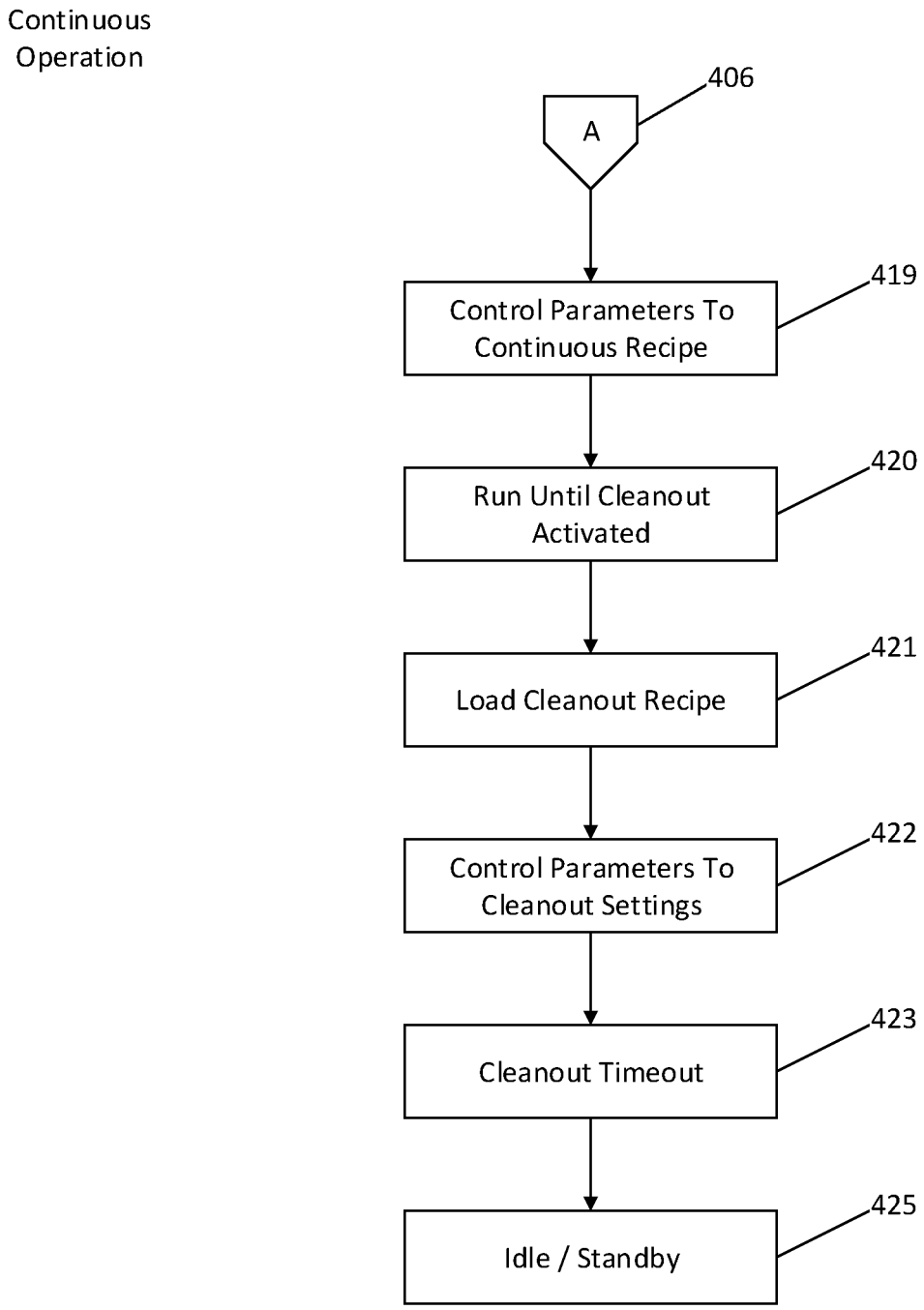

FIG. 4B shows an illustrative continuous operation process. After continuous operation is initiated (e.g., in step 406 of FIG. 4A), the control parameters may be set 419 to control parameters corresponding to a continuous recipe. The continuous operation may run 420 until a cleanout is activated. The cleanout recipe may be loaded 421. The control parameters may be set 422 to cleanout settings. The cleanout operation may run until a cleanout timeout is reached 423. The machine may then wait in idle or standby mode 425 until a next process is activated (e.g., until a machine shutdown process is activated, and the dryer moves to step 436 of FIG. 4D).

Figure 4C:
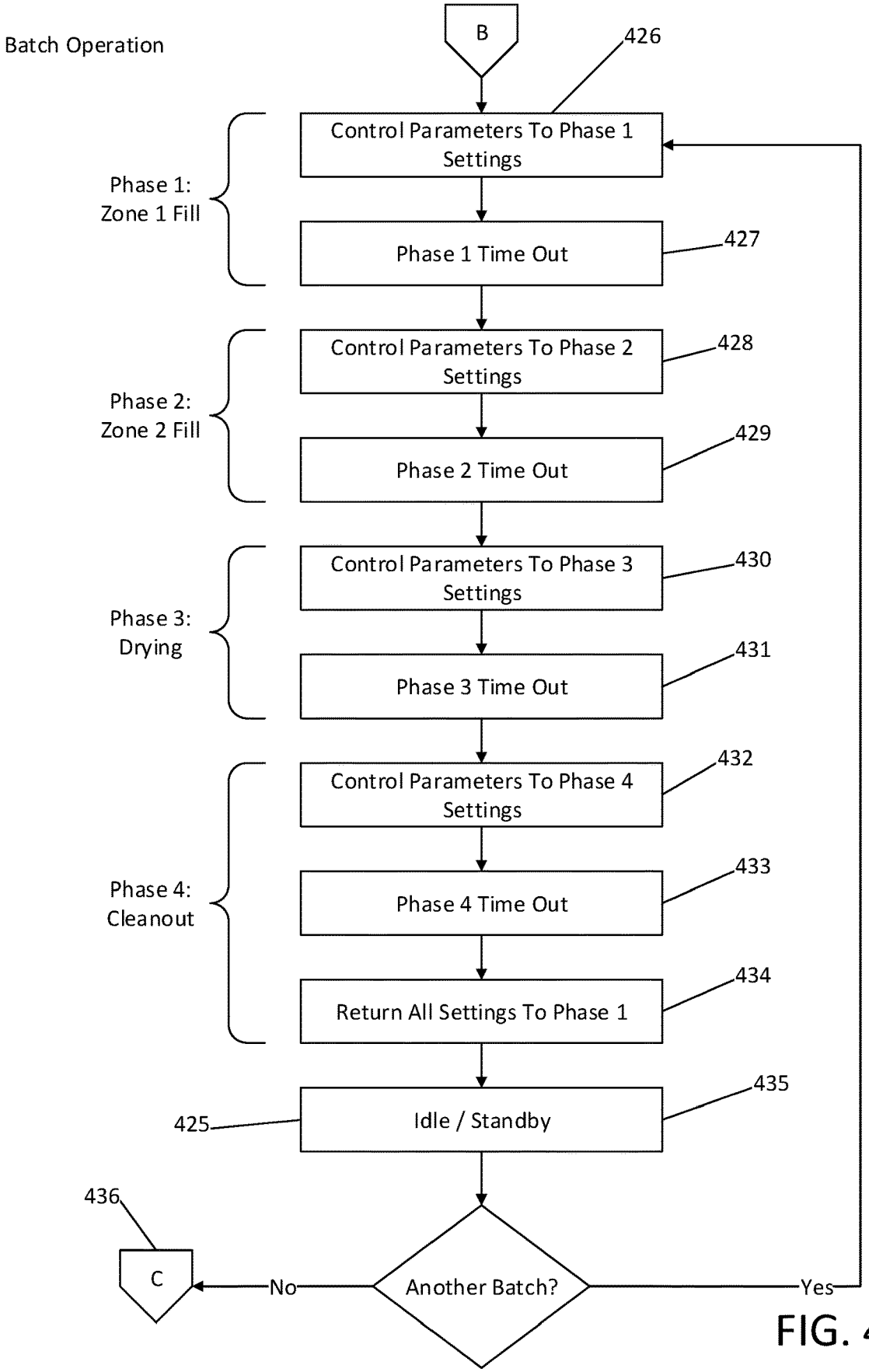

FIG. 4C shows an illustrative batch operation process from step 418 of FIG. 4A. A batch process may include one or more sub-processes. For example, a batch process may include a first phase (e.g., zone 1 fill), a second phase (e.g., zone 2 fill), a third phase (e.g., drying), and/or a fourth phase (e.g., cleanout).

During a first phase (e.g., zone 1 fill), one or more control parameters may be set 426 to phase 1 settings. The dryer may operate based on the control parameters for phase 1 settings until a phase 1 timeout is reached 427.

During a second phase (e.g., zone 2 fill), one or more control parameters may be set 428 to phase 2 settings. The dryer may operate based on the control parameters for phase 2 settings until a phase 2 timeout is reached 429.

During a third phase (e.g., drying), one or more control parameters may be set 430 to phase 3 settings. The dryer may operate based on the control parameters for phase 3 settings until a phase 3 timeout is reached 431.

During a fourth phase (e.g., cleanout), one or more control parameters may be set 432 to phase 4 settings. The dryer may operate based on the control parameters for phase 4 settings until a phase 4 timeout is reached 433. The dryer may then return 434 all settings to phase 1 settings. The dryer may then wait in idle or standby mode 435.

If another batch is desired in step 436, the dryer may return to step 426 and set the control parameters to phase 1 settings. If another batch is not desired, a machine shutdown process may be activated, and the dryer moves to step 437.

Figure 4D:
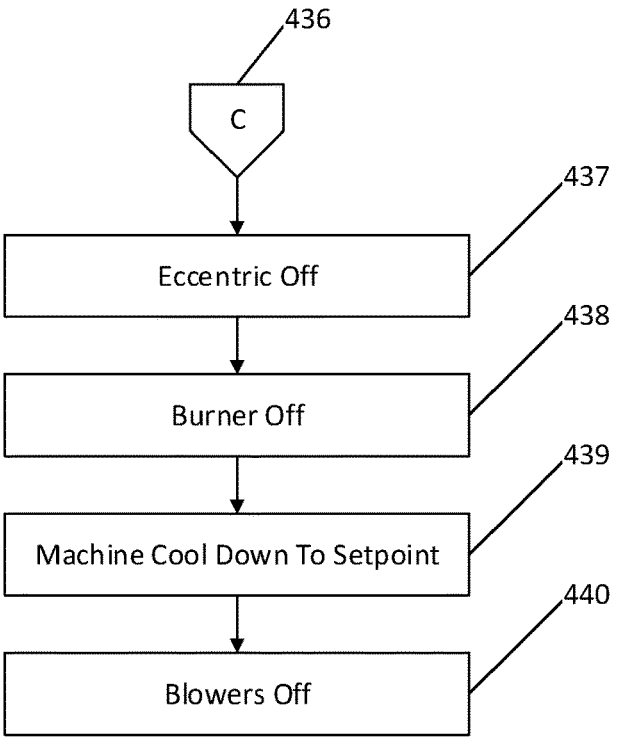

FIG. 4D shows an illustrative machine shutdown process. After step C 437 of FIG. 4C, in step 438, the eccentric is turned off. In step 439, the burner is turned off. In step 440, the machine may cool down until the machine reaches a setpoint temperature. In step 441, the blowers may be turned off.

Figure 7A:
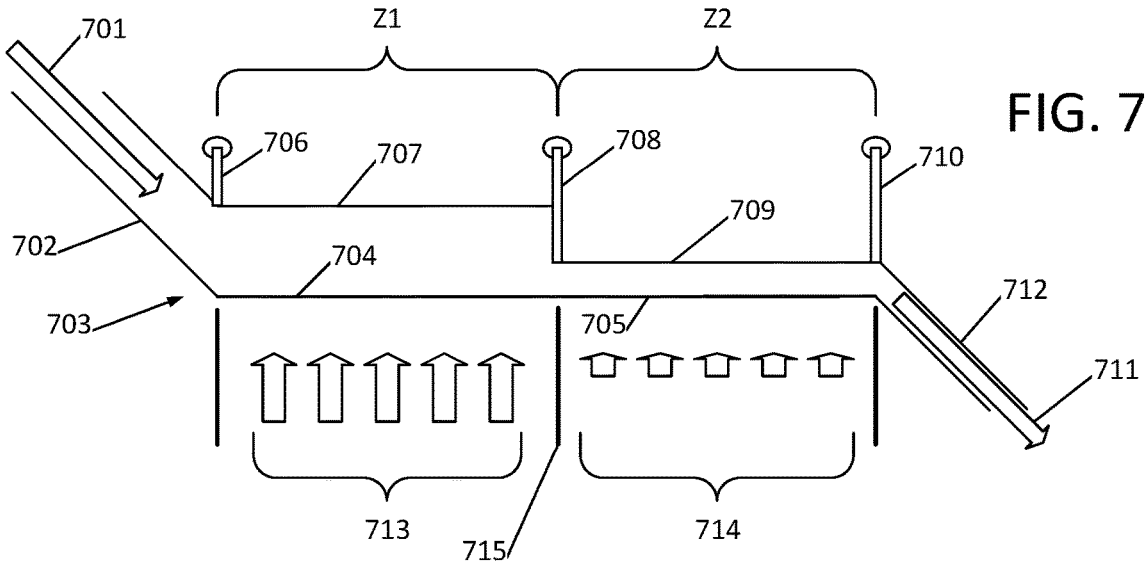
FIGS. 7A-7C show illustrative operations of a vibratory fluidized bed dryer in accordance with one or more embodiments described herein.
Figure 7B:
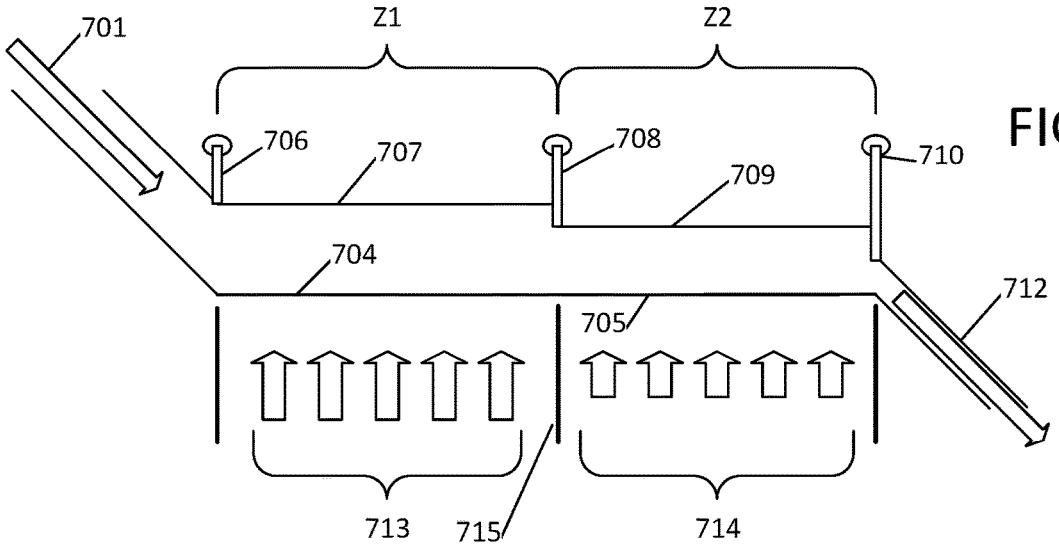
Figure 7C:
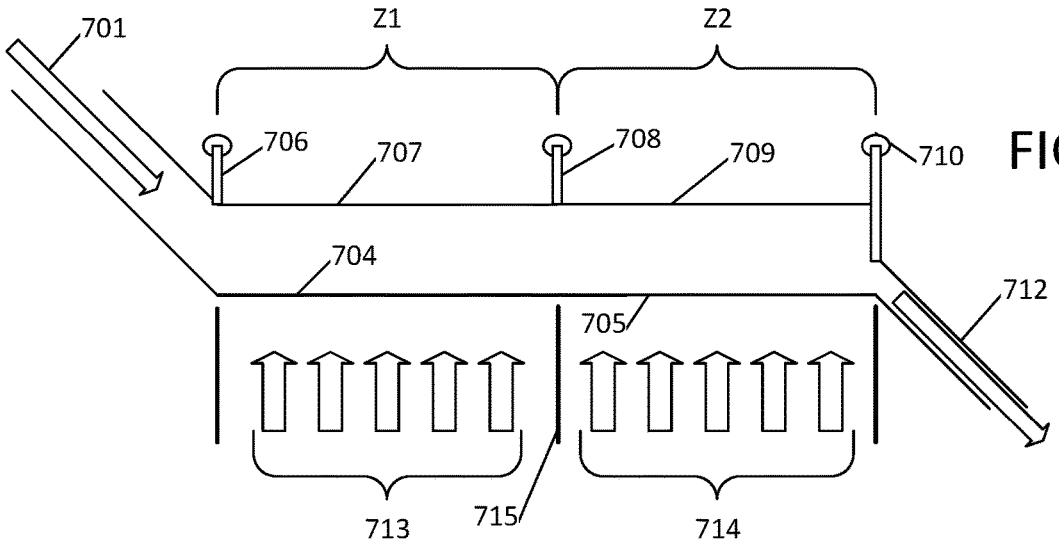

FIGS. 7A-7C show an illustrative series showing operation of a fluidized bed dryer to process material. Incoming material 701 may be added to the fluidized bed dryer via incoming hopper 702. Incoming material 701 may accumulate on deck 703, which may include feed-side deck 704 and discharge-side deck 705. When the material is initially added to the fluidized bed dryer, the material may accumulate on feed-side deck 704.

The fluidized bed dryer may include one or more gates. For example, the fluidized bed dryer may include incoming gate 706, middeck gate 708, and/or discharge gate 710. Each gate may cause the material to stay on a certain part of the fluidized bed dryer (e.g., feed-side deck 704, discharge-side deck 705) for a threshold period of time.

As shown in FIG. 7A, material level in feed-side product level 707 may be relatively high after the incoming material 702 is added to the fluidized bed dryer. As the fluidized bed dryer vibrates (e.g., due to the motion of the eccentric), and as air (e.g., air 713) passes through the feed-side deck, the material in feed-side product level 707 may be dried, and have a reduced volume over time (as shown by material level in feed-side product level 707 in FIG. 7B and FIG. 7C). The material in feed-side product level 707 may also move to discharge-side product level 709.

As the material is drying and the deck 703 is vibrating, material may pass middeck gate 708 (which may be partially or fully open), and move to a discharge-side section (e.g., discharge-side deck 705) of the deck (e.g., deck 703). When material 702 is first added to the fluidized bed dryer, the material level in discharge-side product level 709 may be relatively low, as shown in FIG. 7A. The material may dry and/or move to discharge-side product level 709 from feed-side product level 707, as shown in FIG. 7B and FIG. 7C. The airflow 713 and 714 may be controlled through the introduction of material at different depths on the bed and/or through separation of the airchest via one or more baffles 715. In an example with no baffle 715, the volume of product 707 and 709 may be varied to control the airflow through each section. For instance, with no product 709, all air may flow through the discharge-side deck 705. However, by adding some product 709, enough resistance may be created to permit fluidization of product 707 at feed-side deck 704. In this example, reference numerals 713 and 714 may refer to the resistance to airflow with the product 709 offering less air flow resistance 714 than product 707 providing air flow resistance 713.

As the fluidized bed dryer vibrates (e.g., due to the motion of the eccentric), and as air (e.g., air 714) passes through the discharge-side deck, the material in discharge-side product level 709 may be dried, and have a reduced volume over time. The air that passes over the discharge-side section of the deck (e.g., air 714) may flow through a discharge-side section (e.g., discharge-side deck 705) of the deck (e.g., deck 703), and may flow in parallel with other airflow across the deck (e.g., air 713 that passes through the feed-side deck 704).

Eventually, the material may discharge from the fluidized bed dryer as discharge material 711, which may discharge via discharge hopper 712.

Figure 8:
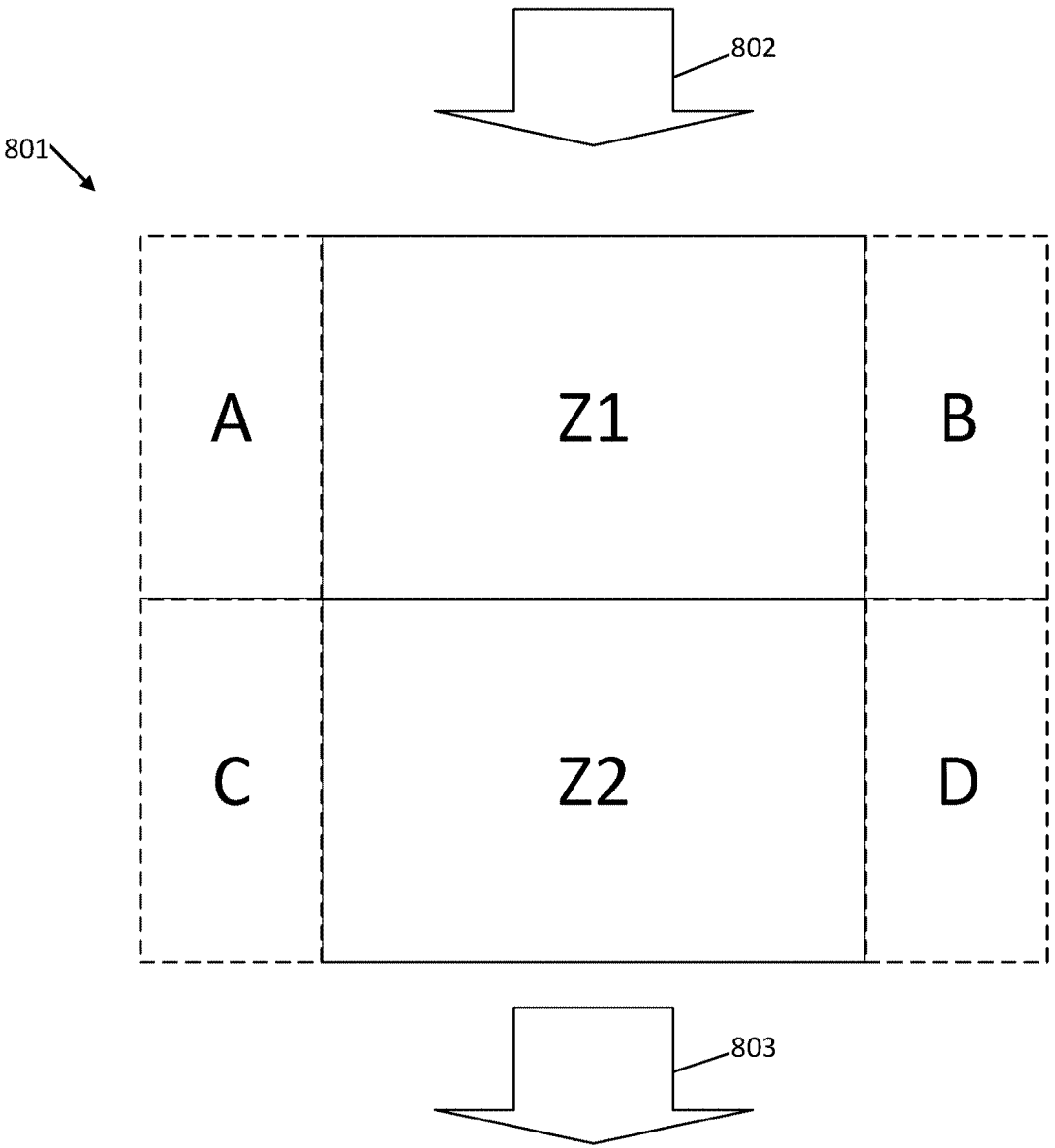
FIG. 8 shows an illustrative top view of a vibratory fluidized bed dryer in accordance with one or more embodiments described herein.

FIG. 8 shows an illustrative overhead view of a flow path across a fluidized bed dryer. Incoming material 802 may be added to the fluidized bed dryer, and may begin to pass across the modular deck 801, beginning at feed-side deck Z1. One or more heaters and/or blowers (e.g., modular heater/blower A, modular heater/blower B) may blow air (which may or may not be heated) across feed-side deck Z1.

Vibration of the deck (e.g., feed-side deck Z1, discharge-side deck Z2) may cause the material to move from feed-side deck Z1 to discharge-side deck Z2. One or more gates may divide feed-side deck Z1 from discharge-side deck Z2, and the one or more gates may stay closed until the material is dry enough to move from feed-side deck Z1 to discharge-side deck Z2.

As the material is passing across discharge-side deck Z2, one or more heaters and/or blowers (e.g., modular heater/blower C, modular heater/blower D) may blow air (which may or may not be heated) across discharge-side deck Z2.

After passing across discharge-side deck Z2, the material may discharge from discharge-side deck Z2 as discharge material 803.

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one or more of the steps illustrated in the illustrative figures may be performed in other than the recited order, and one or more depicted steps may be optional in accordance with aspects of the disclosure.

What is claimed is:

1. A method comprising:

activating, by a controller, a blower of a fluidized bed dryer;

activating, by the controller, a heater of the fluidized bed dryer;

initiating, by the controller, a purge cycle of the fluidized bed dryer;

initiating, by the controller, a pilot of the fluidized bed dryer;

engaging, by the controller, a burner of the fluidized bed dryer;

sending, by the controller, a command configured to spool a feedback loop of the fluidized bed dryer;

determining whether a setpoint temperature has been achieved by the heater of the fluidized bed dryer;

after determining that the setpoint temperature has been achieved by the heater of the fluidized bed dryer, initiating a continuous operation mode of the fluidized bed dryer;

setting, by the controller, one or more control parameters of the fluidized bed dryer to a continuous recipe for the continuous operation mode of the fluidized bed dryer;

determining that a cleanout process of the fluidized bed dryer has been activated;

loading, by the controller, a cleanout recipe for the cleanout process of the fluidized bed dryer;

setting, by the controller, the one or more control parameters of the fluidized bed dryer to the cleanout recipe for the cleanout process of the fluidized bed dryer;

determining that a cleanout timeout has been reached; and activating an idle mode of the fluidized bed dryer.

2. The method of claim 1, wherein setting the one or more control parameters of the fluidized bed dryer comprises:

setting an eccentric speed of the fluidized bed dryer;

setting a process air mass flow rate of the fluidized bed dryer;

setting a mid-deck gate level of the fluidized bed dryer;

setting a discharge gate level of the fluidized bed dryer; and setting a burner temperature of the fluidized bed dryer.

3. The method of claim 2, comprising:

activating a mid-deck gate actuator of the fluidized bed dryer based on the mid-deck gate level of the fluidized bed dryer.

4. The method of claim 2, comprising:

activating a discharge gate actuator of the fluidized bed dryer based on the discharge gate level of the fluidized bed dryer.

5. The method of claim 1, comprising:

receiving temperature information for the fluidized bed dryer from one or more thermocouples associated with the fluidized bed dryer.

6. The method of claim 5, comprising:

adjusting a heater temperature of a heater of the fluidized bed dryer based on the temperature information from the fluidized bed dryer.

7. The method of claim 5, comprising:

adjusting a blower speed of the blower of the fluidized bed dryer based on the temperature information from the fluidized bed dryer.

8. The method of claim 5, comprising:

deactivating, by the controller, an eccentric of the fluidized bed dryer;

deactivating, by the controller, the burner of the fluidized bed dryer;

determining that the fluidized bed dryer has cooled below a setpoint temperature; and after determining that the fluidized bed dryer has cooled below the setpoint temperature, deactivating, by the controller, the blower of the fluidized bed dryer.

9. A system comprising:

a fluidized bed dryer comprising:

a deck;

an eccentric;

a blower;

a mid-deck gate; and a discharge gate;

a control device comprising:

at least one processor; and memory storing executable instructions that, when executed by the at least one processor, cause the control device to:

receive a control recipe comprising one or more control parameters;

based on the control recipe comprising the one or more control parameters:

set an operational speed of the eccentric, and set an operational speed of the blower;

determine that the fluidized bed dryer has been operating based on the one or more control parameters for a threshold period of time; and based on determining that the fluidized bed dryer has been operating based on the one or more control parameters for the threshold period of time, activate a shutdown process for the fluidized bed dryer.

10. The system of claim 9, further comprising:

a heater, wherein the deck configured such that the deck is flat relative to a ground while the fluidized bed dryer is in operation.

11. The system of claim 9, wherein the executable instructions of the memory of the control device, when executed, cause the control device to:

determine a temperature of material being dried by the fluidized bed dryer; and adjust the operational speed of the eccentric based on the temperature of the material being dried by the fluidized bed dryer.

12. The system of claim 9, wherein the executable instructions of the memory of the control device, when executed, cause the control device to:

determine a humidity of material being dried by the fluidized bed dryer; and adjust the operational speed of the eccentric based on the humidity of the material being dried by the fluidized bed dryer.

* * * * *